US011243489B2

(12) United States Patent
Harada

(10) Patent No.: US 11,243,489 B2
(45) Date of Patent: Feb. 8, 2022

(54) FIXING DEVICE AND METHOD FOR CONTROLLING FIXING DEVICE

(71) Applicant: BROTHER KOGYO KABUSHIKI KAISHA, Nagoya (JP)

(72) Inventor: Yuya Harada, Anjo (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/114,632

(22) Filed: Dec. 8, 2020

(65) Prior Publication Data

US 2021/0200125 A1 Jul. 1, 2021

(30) Foreign Application Priority Data

Dec. 27, 2019 (JP) ..... JP2019-238874
Dec. 27, 2019 (JP) ..... JP2019-238888

(51) Int. Cl.
*G03G 15/20* (2006.01)
*G03G 15/00* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2010/0061754 A1* 3/2010 Ishigaya ..... G03G 15/5004 399/70
2011/0142475 A1* 6/2011 Kim ..... G03G 15/2039 399/69
2012/0224878 A1 9/2012 Ikebuchi et al.

FOREIGN PATENT DOCUMENTS

| | | | |
|---|---|---|---|
| JP | 10-10914 | A | 1/1998 |
| JP | 11-161086 | A | 6/1999 |
| JP | 2001-117409 | A | 4/2001 |
| JP | 2001-265155 | A | 8/2001 |
| JP | 2003-217793 | A | 7/2003 |
| JP | 2010-96969 | A | 4/2010 |
| JP | 2012-185295 | A | 9/2012 |

* cited by examiner

*Primary Examiner* — Clayton E. LaBalle
*Assistant Examiner* — Michael A Harrison
(74) *Attorney, Agent, or Firm* — Merchant & Gould P.C.

(57) ABSTRACT

An fixing device comprises a heating member, a first heater, a second heater, and the heating member, a first temperature detector, a second temperature detector, and a controller configured to control energization to the first heater and the second heater based on an energization pattern for each control period. In a case where a length of the control period is T, a length of a period during which a first continuous energization control is T1, and a length of a period during which a second continuous energization control is T2, when a first condition represented by T1+T2<T is satisfied, the controller starts the second continuous energization control just after an end of the first continuous energization control.

20 Claims, 11 Drawing Sheets

FIXING DEVICE AND METHOD FOR CONTROLLING FIXING DEVICE

CROSS REFERENCE TO RELATED APPLICATIONS

The present application claims priority from Japanese Patent Application No. 2019-238874, which was filed on Dec. 27, 2019, and Japanese Patent Application No. 2019-238888, which was filed on Dec. 27, 2019, the disclosure of which is herein incorporated by reference in its entirety.

BACKGROUND

The following disclosure relates to a fixing device having a plurality of heaters and a method for controlling the fixing device.

There has been known a fixing device executing a continuous energization control in which AC current is continuously applied and a phase control in which a phase angle is changed before and after the continuous energization control with respect to respective two heaters in a control period. In this technique, energization is executed so that an execution period of the phase control with respect to one heater and an execution period of the phase control with respect to the other heater do not overlap, thereby suppressing occurrence of harmonic current.

SUMMARY

Incidentally, there is a case where a time interval is generated between the continuous energization control with respect to one heater and the continuous energization control with respect to the other heater in a control period in the technique. In this case, it is possible that, after momentary voltage drop that causes a flicker occurs in the continuous energization control to the one heater, momentary voltage drop occurs also in the continuous energization control to the other heater. That is, the momentary voltage drop may occur twice in the control period.

In view of the above, an object of the present disclosure is to reduce occurrence frequency of momentary voltage drop in the control period.

In order to solve the problems, a fixing device includes a heating member configured to heat a sheet, a first heater having an output peak in a first area of the heating member and configured to heat the heating member, a second heater having an output peak in a second area different from the first area of the heating member and configured to heat the heating member, a first temperature detector configured to detect a temperature of the first area, a second temperature detector configured to detect a temperature of the second area, and a controller configured to control energization to the first heater and the second heater based on an energization pattern determined by a first detected temperature detected by the first temperature detector and a second detected temperature detected by the second temperature detector for each control period. In a case where a length of the control period is T, a length of a period during which a first continuous energization control in which first AC current is continuously applied to the first heater is executed is T1, and a length of a period during which a second continuous energization control in which second AC current is continuously applied to the second heater is executed is T2, when a first condition represented by T1+T2<T is satisfied, the controller starts the second continuous energization control just after an end of the first continuous energization control.

A method for controlling a fixing device according to the present disclosure which includes a heating member configured to heat a sheet, a first heater having an output peak in a first area of the heating member and configured to heat the heating member, a second heater having an output peak in a second area different from the first area of the heating member and configured to heat the heating member. The method comprises the steps of controlling energization to the first heater and the second heater based on an energization pattern determined by a temperature of the first area and a temperature of the second area; and starting a second continuous energization control just after an end of a first continuous energization control when a first condition represented by T1+T2<T is satisfied in a case where a length of the control period is T, a length of the control period is T, a length of a period during which a first continuous energization control in which first AC current is continuously applied to the first heater is executed is T1, and a length of a period during which a second continuous energization control in which second AC current is continuously applied to the second heater is executed is T2.

A fixing device according to another aspect of the present disclosure includes a heating member configured to heat a sheet, a first heater having an output peak in a first area of the heating member and configured to heat the heating member, a second heater having an output peak in a second area different from the first area of the heating member and configured to heat the heating member, a first temperature detector configured to detect a temperature of the first area, and a second temperature detector configured to detect a temperature of the second area, and a controller configured to control energization to the first heater and the second heater based on an energization pattern determined by a first detected temperature detected by the first temperature detector and a second detected temperature detected by the second temperature detector for each control period. The energization pattern includes a prescribed energization pattern in which (i) a first start-time phase control performed is started at a start of the control period and a second end-time phase control is ended at an end of the control period and (ii) a peak current that is a first peak current value in the first start-time phase control agrees with a last peak current value as a composite value of first AC current and second AC current at an end of the second end-time phase control, the first start-time phase control being a control executed before a first continuous energization control in which the first AC current is continuously applied to the first heater is executed and energizing the first heater in parts of sine waves of the first AC current, the second end-time phase control being a control executable after a second continuous energization control in which the second AC current is continuously applied to the second heater is executed and energizing the second heater in parts of sine waves of the second AC current.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENT

Next, an embodiment of the present disclosure will be explained in detail appropriately with reference to the drawings.

Figure 1:
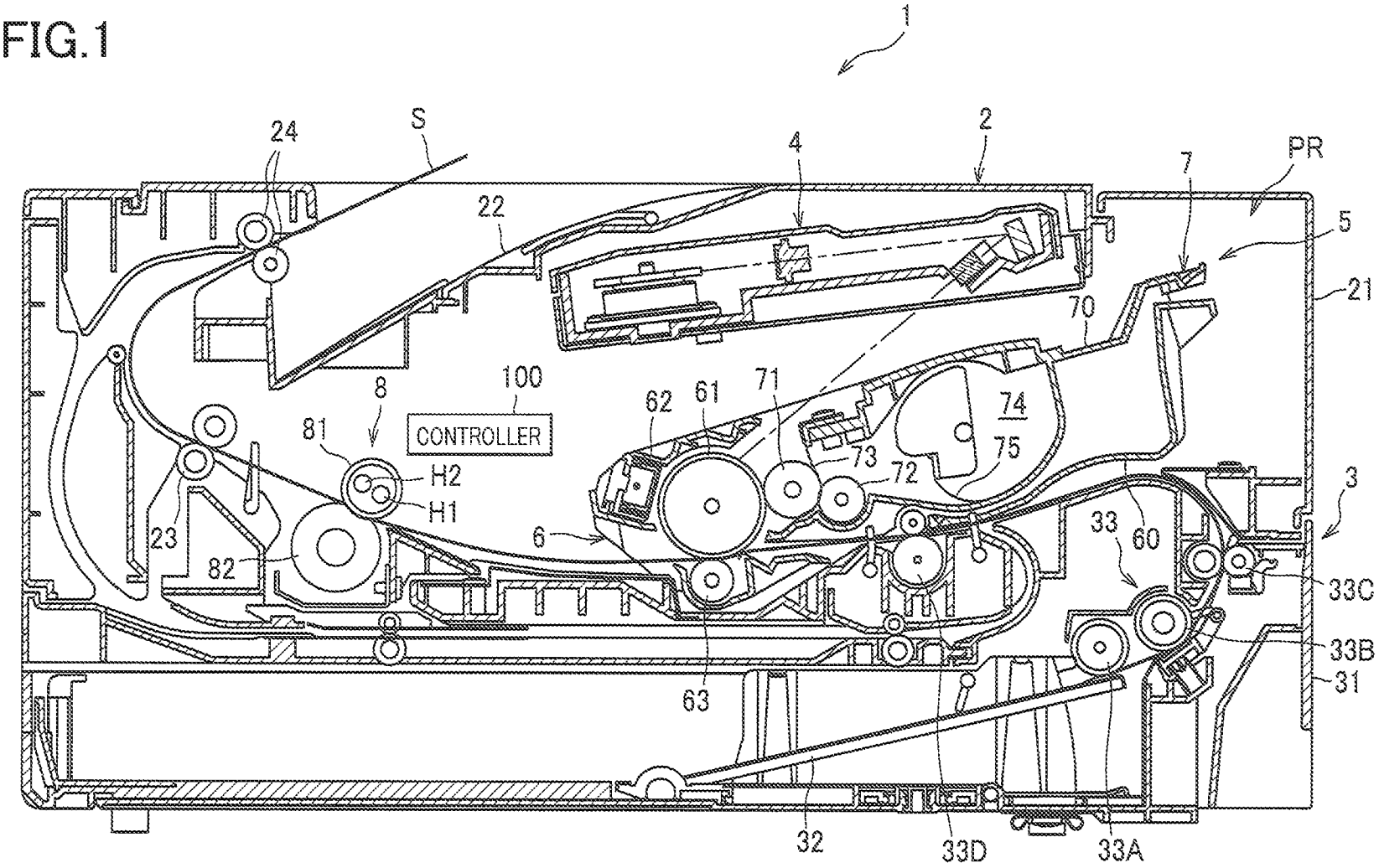
FIG. 1 is a view showing a laser printer according to an embodiment.

As illustrated in FIG. 1, a laser printer 1 is an example of an image forming apparatus forming an image on a sheet S, including a body housing 2, a sheet supplier 3, a process unit PR as an example of a developer image forming portion, a fixing device 8, and a controller 100.

The sheet supplier 3 is a mechanism for supplying the sheet S to the process unit PR, and the sheet supplier 3 is provided at a lower part in the body housing 2. The sheet supplier 3 includes a supply tray 31 for storing the sheets S, a sheet pressing plate 32, and a supply mechanism 33. The supply mechanism 33 includes a pick-up roller 33A, a separating roller 33B, a first conveying roller 33C, and a registration roller 33D. In the sheet supplier 3, the sheet S in the supply tray 31 is attracted to the pick-up roller 33A by the sheet pressing plate 32, and fed to the separating roller 33B by the pick-up roller 33A. The sheets S is separated into one piece by the separating roller 33B and conveyed by the first conveying roller 33C. The registration roller 33D aligns a position of an end of the sheet S, and conveys the sheet S toward the process unit PR. Here, a direction in which the sheet S is conveyed is a conveying direction, and a direction orthogonal to the conveying direction on a plane of the sheet S is a width direction.

The process unit PR has a function of forming a developer image on the sheet S. The process unit PR includes an exposing device 4 and a process cartridge 5.

The exposing device 4 is disposed at an upper part in the body housing 2, and includes a not-illustrated laser light source, a polygon mirror, a lens, a reflective mirror, and so on illustrated without reference signs. In the exposing portion 4, a surface of a photoconductor drum 61 is scanned with laser light emitted from the laser light source based on image data, thereby exposing the surface of the photoconductor drum 61.

The process cartridge 5 is disposed below the exposing device 4, and the process cartridge 5 is attachable on and detachable from the body housing 2 from an opening formed when a front cover 21 provided in the body housing 2 is opened. The process cartridge 5 includes a drum unit 6 and a developing unit 7.

The drum unit 6 includes the photoconductor drum 61, a charging unit 62, and a transfer roller 63. The developing unit 7 is attachable on and detachable from the drum unit 6, and the developing unit 7 includes a developing roller 71, a supply roller 72, a layer-thickness regulation blade 73, a developer container 74 containing a developer which is dry toner, and an agitator 75.

In the process cartridge 5, the surface of the photoconductor drum 61 is uniformly charged by the charging unit 62, then, and exposed by laser light from the exposing device 4 to thereby form an electrostatic latent image based on the image data on the photoconductor drum 61. The developer inside the developer container 74 is supplied to the developing roller 71 through the supply roller 72 while being agitated by the agitator 75, and the developer enters between the developing roller 71 and the layer-thickness regulation blade 73 with the rotation of the developing roller 71 to be carried on the developing roller 71 as a thin layer with a constant thickness.

The developer carried on the developing roller 71 is supplied from the developing roller 71 to the electrostatic latent image formed on the photoconductor drum 61. Accordingly, the electrostatic latent image is visualized, and the developer image is formed on the photoconductor drum 61. After that, the sheet S supplied from the sheet supplier 3 is conveyed between the photoconductor drum 61 and the transfer roller 63, so that the developer image formed on the photoconductor drum 61 is transferred onto the sheet S.

The fixing device 8 is a device configured to fix the developer image formed by the process unit PR on the sheet S. The fixing device 8 includes a heating member 81 configured to heat the sheet 2 and a pressure member 82 sandwiching the sheet S between the pressure member 82 and the heating member 81.

The heating member 81 is a cylindrical heating roller capable of rotating, which is made of metal or the like. A first heater H1 and a second heater H2 for heating the heating member 81 are provided inside the heating member 81. The pressure member 82 is a pressure roller capable of rotating, and has an elastic layer formed of rubber capable of being elastically deformed on a surface of the pressure member 82. In the fixing device 8, the sheet S to which the developer image is transferred is conveyed between the heating member 81 and the pressure member 82 to thereby heat-fix the developer image onto the sheet S. The sheet S on which the developer image is heat-fixed is discharged on an output try 22 by a second conveying roller 23 and an output roller 24.

Figure 2:
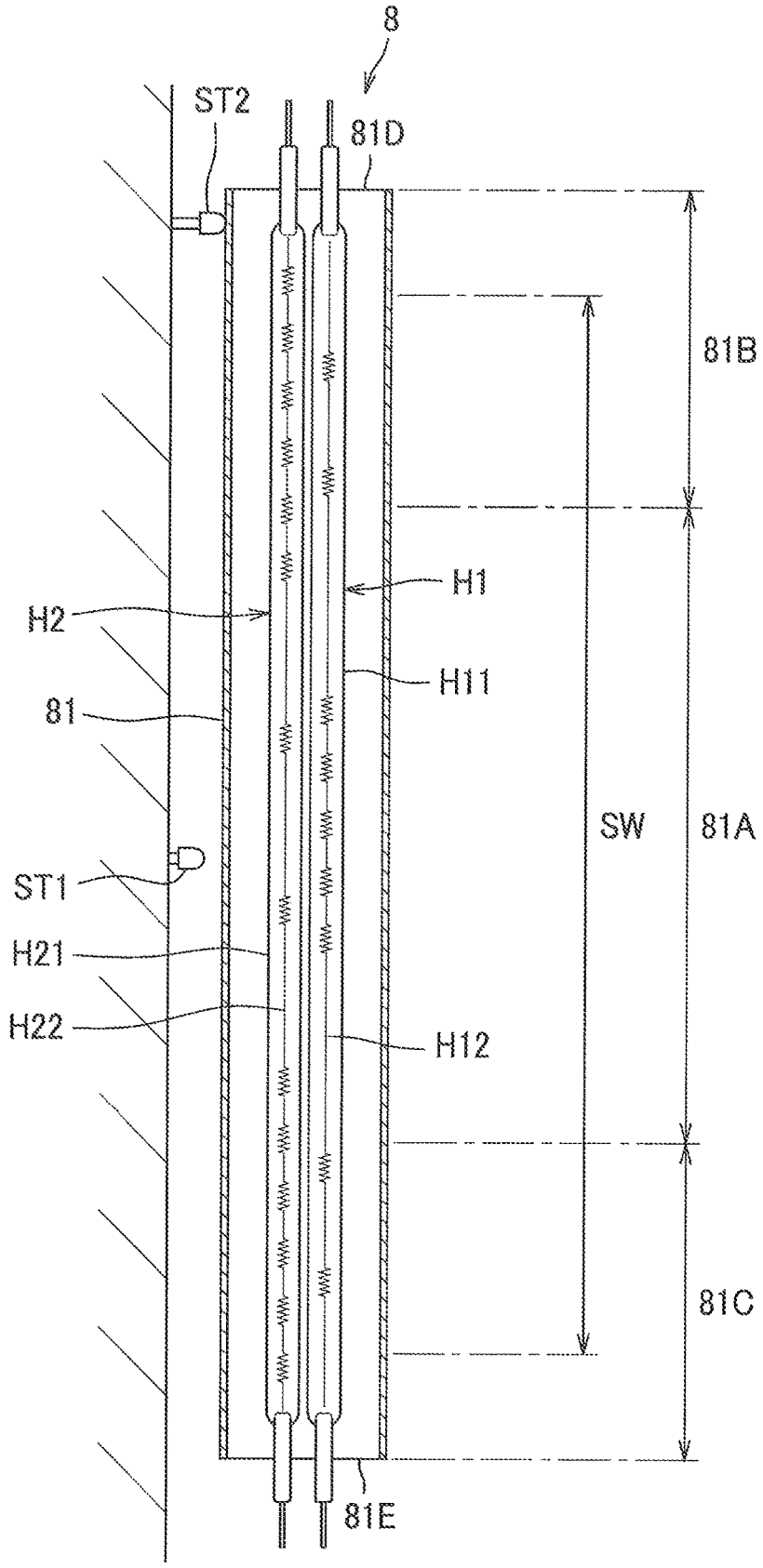
FIG. 2 is a view showing a fixing device.

As illustrated in FIG. 2, the fixing device 8 further includes a first temperature detector ST1 and a second temperature detector ST2 in addition to the above-mentioned heating member 81, the first heater H1, and the second heater H2.

Figure 3:
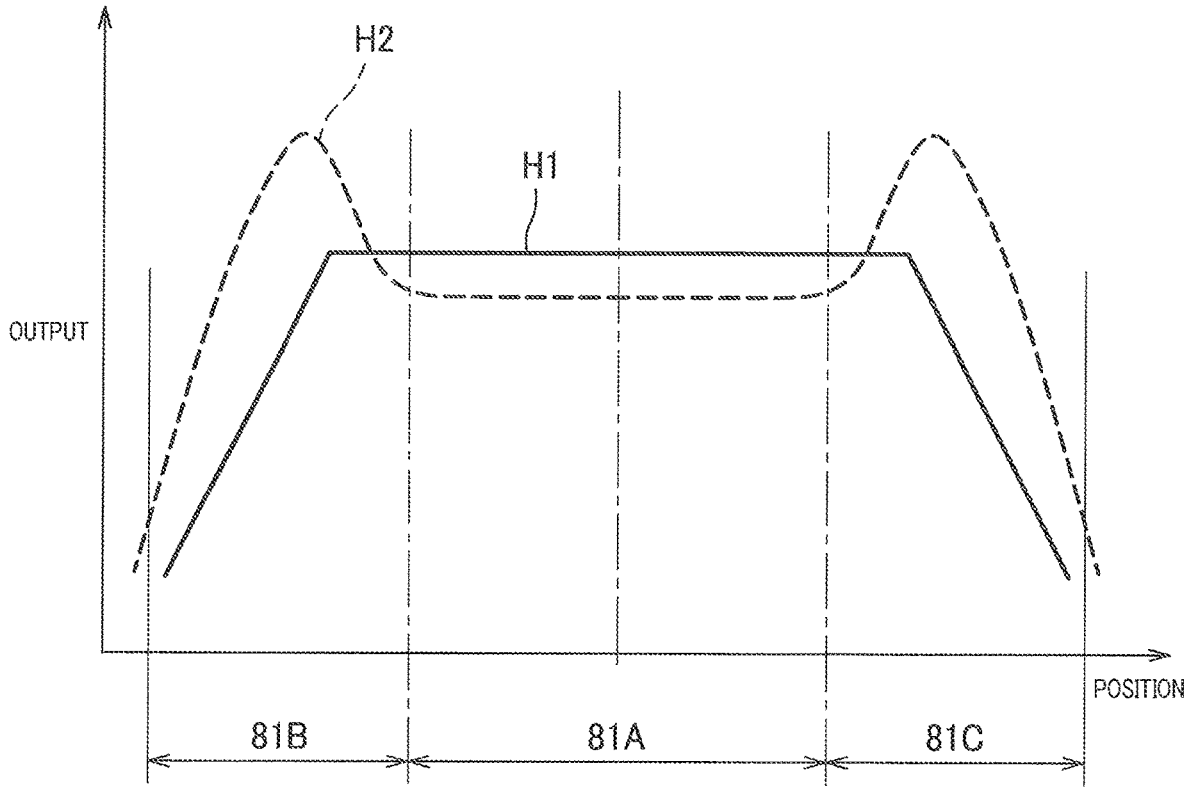
FIG. 3 is a graph showing outputs of respective heaters.

The first heater H1 is a halogen lamp, and has an output peak in a first area 81A including a central part of the heating member 81 in the width direction (see FIG. 3). The first heater H1 includes a glass tube H11 and a filament H12 provided inside the glass tube H11. In the filament H12, a number of light emitting parts disposed at the central part in the width direction is greater than a number of the light emitting parts disposed at each of end parts in the width direction.

The second heater H2 is a halogen lamp, and has output peaks in a second area 81B and a second area 81C respectively disposed at end-part sides of the first area 81A of the heating member 81 (see FIG. 3). The second heater H2 includes a glass tube H21 and a filament H22 provided inside the glass tube H21. In the filament H22, a number of the light emitting parts disposed at each of the end parts in the width direction is greater than a number of the light emitting parts disposed at the central part in the width direction.

Here, the width direction of the heating member 81 is a direction along a rotating axis of the heating member 81, and indicates the same direction as the width direction of the sheet S. The first area 81A of the heating member 81 corresponds to a range including a center of the heating member 81 in the width direction, and the second area 81B disposed on one end side of the heating member 81 is a range between an edge 81D disposed on one end side of the heating member 81 in the width direction and the first area 81A. The second area 81C disposed on the other end side of the heating member 81 is a range between an edge 81E disposed on the other end side of the heating member 81 in the width direction and the first area 81A.

As illustrated by a solid line in FIG. 3, the output of the first heater H1 has a distribution in which the output is the highest at the center in the width direction and is gradually reduced toward both ends of the heating member 81 in the width direction. Accordingly, heating ability of the first heater H1 with respect to the first area 81A of the heating member 81 is higher than heating ability of the first heater H1 with respect to each of the second area 81B and the second area 81C. The output of the second heater H2 has a distribution in which the output is higher at end part sides than at the center in the width direction as illustrated by a broken line. Accordingly, heating ability of the second heater H2 with respect to each of the second area 81B and the second area 81C of the heating member 81 is higher than heating ability of the second heater H2 with respect to the first area 81A in the second heater H2. The heating member 81 is set so that a range in which the output of the first heater H1 is the highest does not overlap a range in which the output of the second heater H2 is the highest.

The output of the first heater H1 with respect to each of the second area 81B and the second area 81C is 30% or less of the output of the first heater H1 with respect to the first area 81A. The output of the second heater H2 with respect to the first area 81A is 80% or less of the output of the second heater H2 with respect to each of the second area 81B and the second area 81C.

As a method for detecting the output of the respective heaters H1, H2, for example, there is a method in which an optical sensor for detecting light of the heater is disposed apart from the heater by a predetermined distance to detect a light amount. Here, the predetermined distance is a distance from the heater to an inner circumferential surface of the heating member 81.

As illustrated in FIG. 2, the first temperature detector ST1 is a sensor configured to detect a temperature of at least a part of the first area 81A of the heating member 81. The first temperature detector ST1 is not in contact with the heating member 81. Specifically, the first temperature detector ST1 is disposed with a clearance from an outer circumferential surface of the heating member 81.

The second temperature detector ST2 is a sensor configured to detect a temperature of at least a part of the second area 81B on one end side of the heating member 81 in the width direction. The second temperature detector ST2 is in contact with the second area 81B of the heating member 81. The second temperature detector ST2 is deviated from a largest area SW of the sheet S toward the edge 81D side on one end side. The largest area SW is an area in which a fixed area of the developer image fixed by the fixing device 8 becomes maximum.

As the first temperature detector ST1 and the second temperature detector ST2, for example, thermistors and so on can be used.

Figure 4:
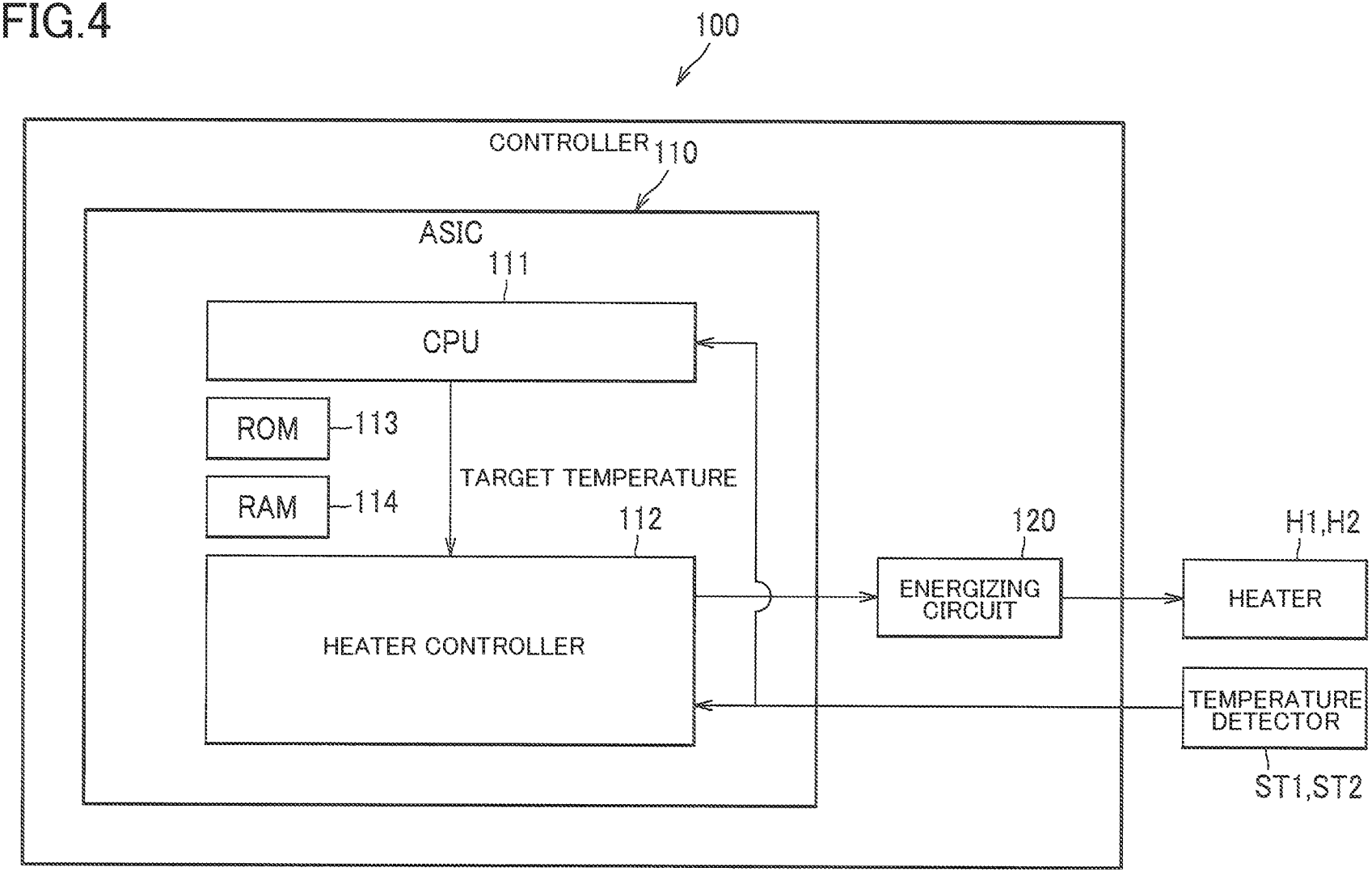
FIG. 4 is a block diagram showing a configuration of a controller.

As illustrated in FIG. 4, the controller 100 includes an ASIC 110 and an energizing circuit 120. The ASIC 110 includes a CPU 111 and a heater controller 112. The energizing circuit 120 is a circuit including a switching circuit that switches inputted AC voltage between an energized state and a non-energized state, and so on, and the energizing circuit 120 is connected to the heater H1, the heater H2, and the ASIC 110.

The CPU 111 is mounted as a function in the ASIC 110. The CPU 111 outputs a first target temperature as a target temperature of the first area 81A and a second target temperature as a target temperature of the second area 81B to the heater controller 112. Each of the target temperatures is a command value in a feedback processing executed when the heater controller 112 executes a energization control to the first heater H1 and the second heater H2.

The heater controller 112 is a function or a circuit created in the ASIC 110, and executes energization to each of the heater H1 and heater H2 by controlling the energizing circuit 120 so that each of the detected temperatures by each of the first temperature detector ST1 and the second temperature detector ST2 becomes each of the target temperatures. Specifically, the heater controller 112 determines a duty ratio of AC voltage applied to each of the heater H1 and the heater H2 based on each of the detected temperatures and each of the target temperatures, and executes the feedback processing for controlling the energizing circuit 120 with the determined duty ratio. The feedback processing executed by the heater controller 112 may be mounted on an external chip of the ASIC 110 and may be executed in the CPU 111.

The controller 100 executes control by performing various types of computing processing based on a printing command outputted from an external computer, detected temperatures detected by the first temperature detector ST1 and the second temperature detector ST2, and programs or data stored in storage units such as a ROM 113 and a RAM 114. In other words, the controller 100 functions as a means for executing various controls by operating in accordance with programs.

The controller 100 has a function of controlling energization to the first heater H1 and the second heater H2 based on an energization pattern P determined in each control period T by a first detected temperature detected by the first temperature detector ST1 and a second detected temperature detected by the second temperature detector ST2. Here, the control period T is a predetermined unit time in which the energization pattern of each of the heater H1 and the H2 is set. The controller 100 selects the energization pattern P based on a first deviation D1 as a deviation between the first target temperature and the first detected temperature, a second deviation D2 as a deviation between the second target temperature and the second detected temperature, and a table illustrated in FIG. 5.

Figure 5:
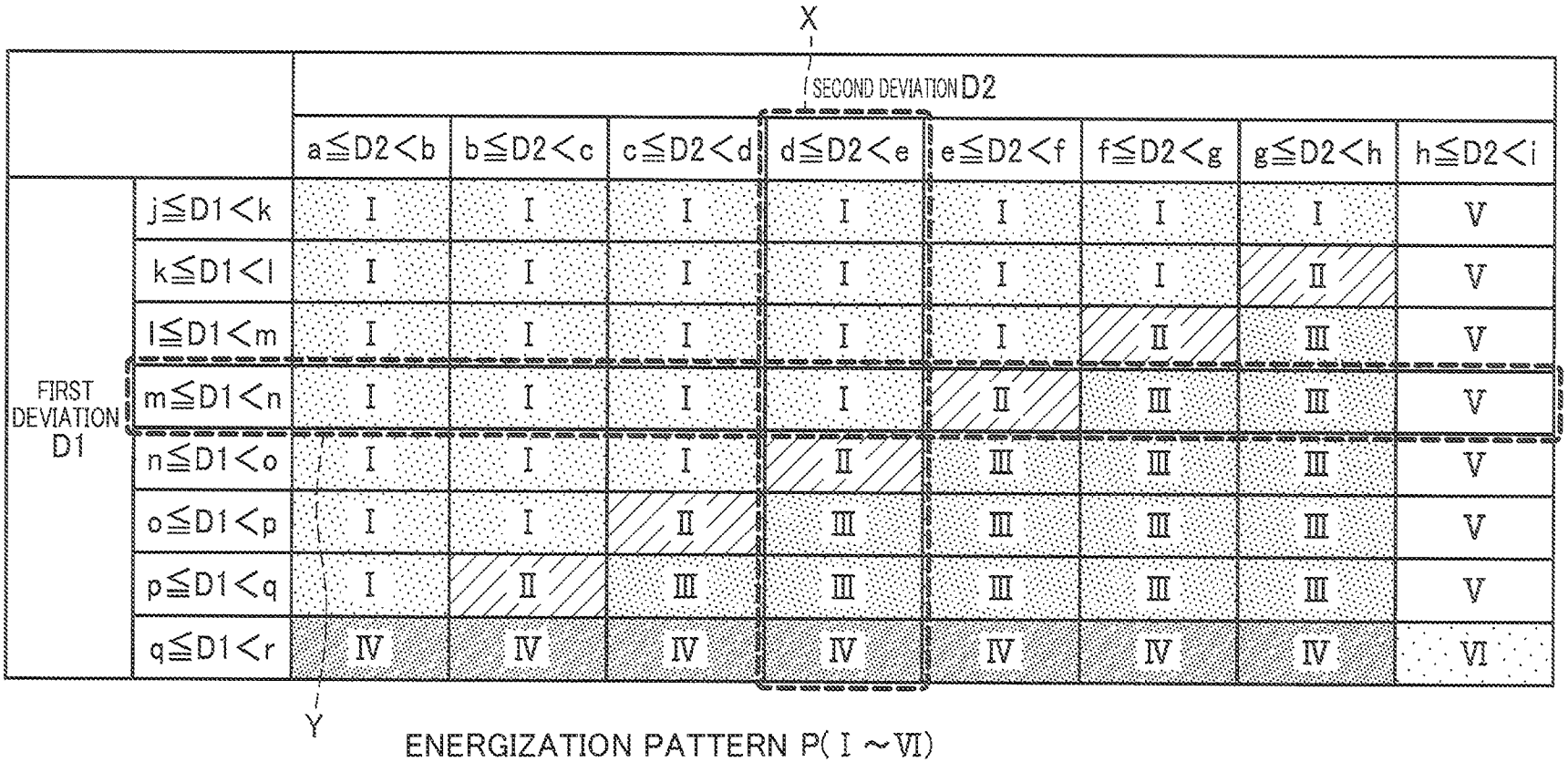
FIG. 5 is a chart showing a table for determining an energization pattern.

The table illustrated in FIG. 5 is a table previously set by experiments, simulations and so on, and the table is stored in the ROM 113 or the RAM 114. Here, a magnitude relationship among numerical values "a" to "i" is $a<b<c<d<e<f<g<i$. A magnitude relationship among numerical value "j" to "r" is $j<k<l<m<n<o<p<q<r$.

The energization patterns P are patterns indicating execution periods of various types of energization controls executed to each of the heater H1 and the heater H2 in the control period T. As the energization patterns P, a plurality of types of patterns such as a pattern I, a pattern II, a pattern III, a pattern IV, a pattern V, and a pattern VI are prepared. Some of the energization patterns P of the plurality of types of patterns is illustrated in FIG. 5, and besides, a pattern in which energization to at least one of the heater H1 and the heater H2 is entirely stopped during a period from the beginning to the end of the control period T and so on are prepared as the energization patterns P.

Figure 6:
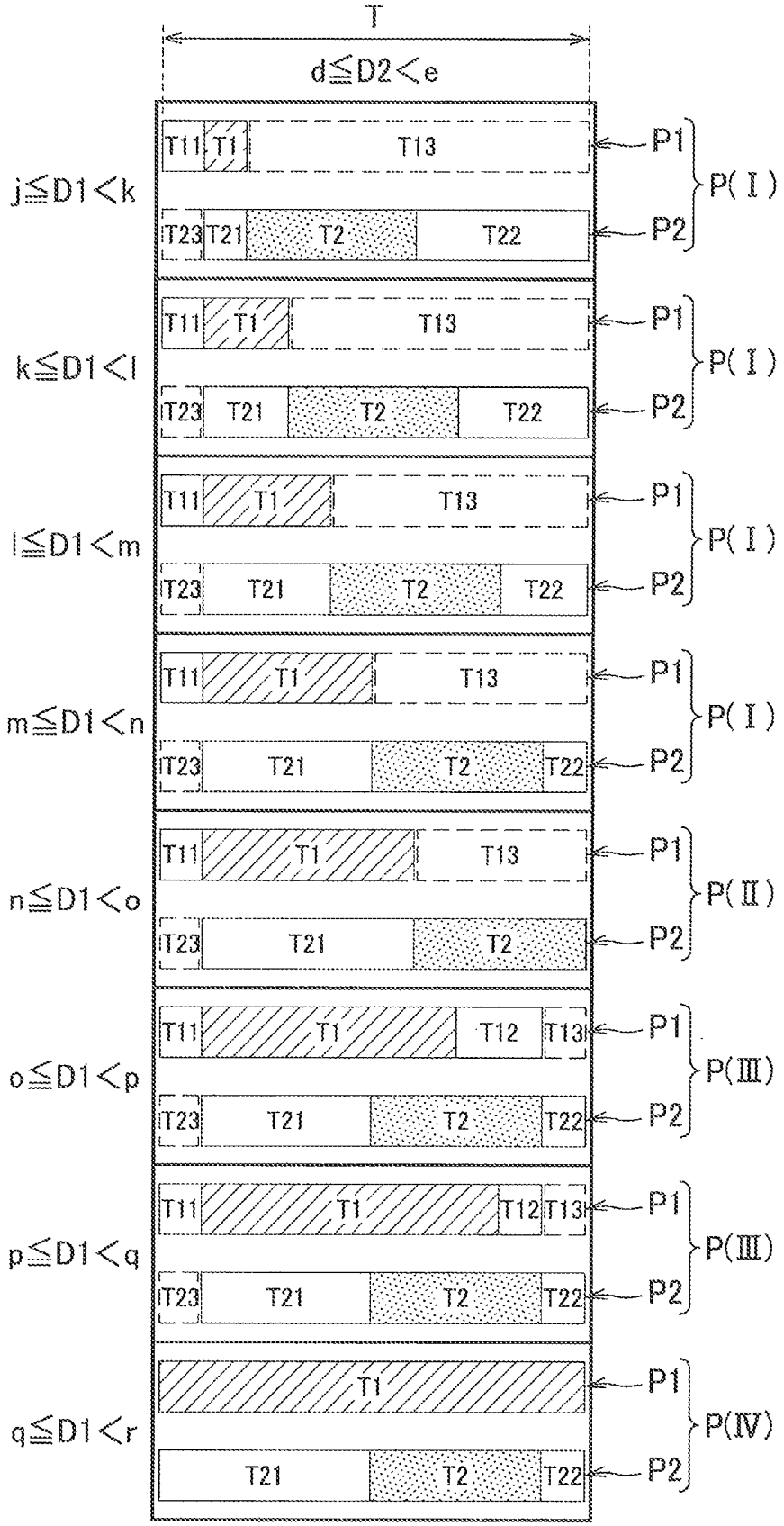
FIG. 6 is a diagram showing energization patterns in columns surrounded by a frame X of FIG. 5.
Figure 7:
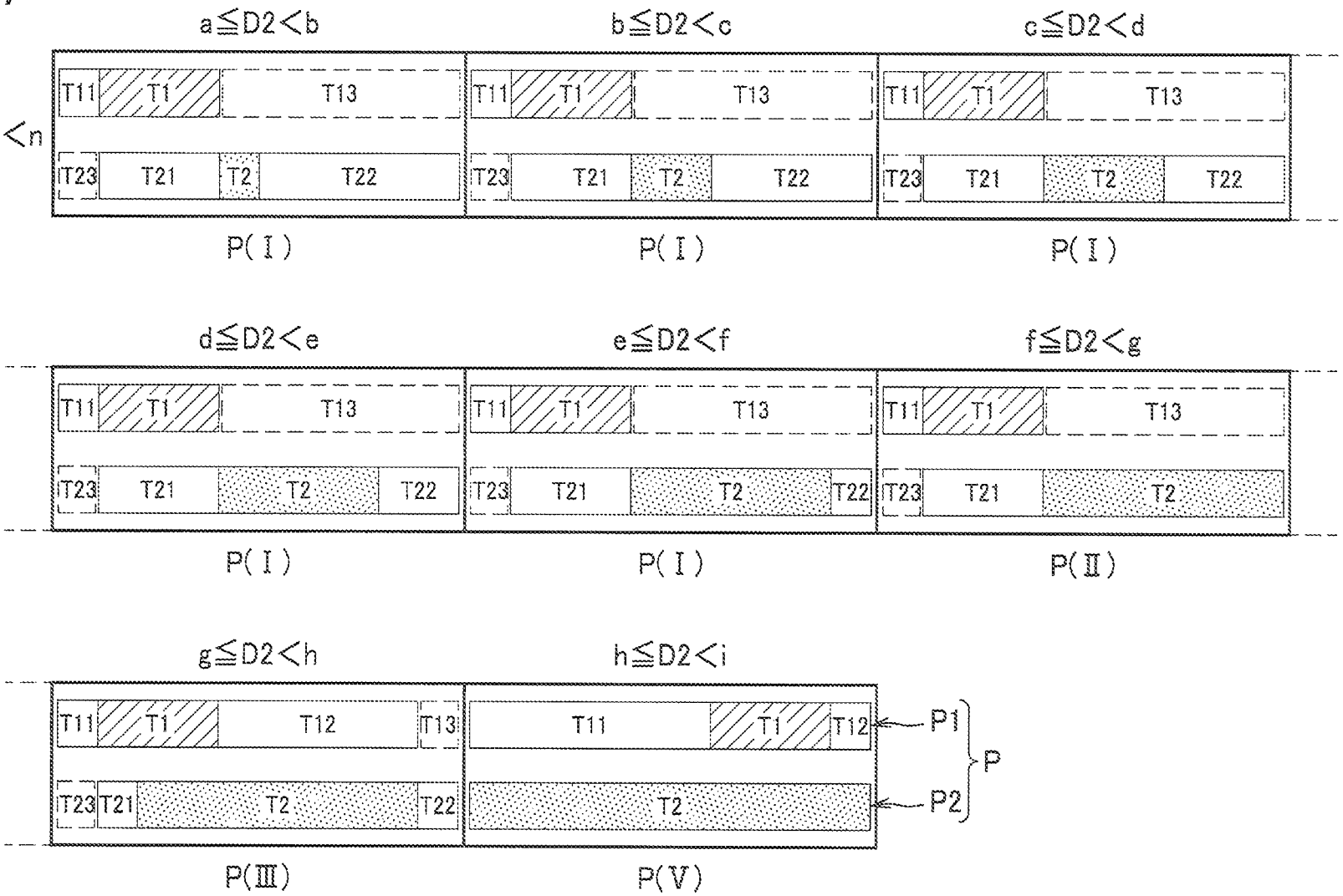
FIG. 7 is a diagram showing energization patterns in columns surrounded by a frame Y of FIG. 5.

As illustrated in FIG. 6 and FIG. 7, each of energization patterns P has a first energization pattern P1 for controlling energization to the first heater H1 and a second energization pattern P2 for controlling energization to the second heater H2. Here, FIG. 6 illustrates energization patterns P (I to IV) in a column of the table surrounded by a broken-line frame X in FIG. 5. FIG. 7 illustrates energization patterns P (I to III, V) in a row of the table surrounded by a broken-line frame Y in FIG. 5.

In the first energization pattern P1, a period T1 and periods T11 to T13 in which a plurality types of energization controls are executed to the first heater H1 are selectively set in the control period T. Hereinafter, the period T1 is also called a "first all on-period", the period T11 is also called a "first start period T11", the period T12 is also called a "first end period T12", and the period T13 is also called a "first off-period T13".

The first start period T11 is a period in which a later-described first start-time phase control is executed. The first all on-period T1 is a period in which a later-described first continuous energization control is executed. The first end period T12 is a period in which a later-described first end-time phase control is executed. The first off-period T13 is a period in which energization to the first heater H1 is entirely stopped. The first all on-period T1 is set to be a longer period as the first deviation D1 becomes greater. The relationship between the first all on-period T1 and the first deviation D1 is not limited to the frame X in FIG. 5 but applies to all columns aligning vertically.

In the second energization pattern P2, a periods T2 and periods T21 to T23 in which a plurality of types of energization controls are executed to the second heater H2 are selectively set in the control period T. Hereinafter, the period T2 is also called a "second all on-period T2", the period T21 is also called a "second start period T21", the period T22 is also called a "second end period T22", and the period T23 is also called a "second off-period T23".

As illustrated in FIG. 7, the second start period T21 is a period in which a later-described second start-time phase control is executed. The second all on-period T2 is a period in which a later-described second continuous energization control is executed. The second end period T22 is a period in which a later-described second end-time phase control is executed. The second off-period T23 is a period in which energization to the second heater H2 is entirely stopped. The second all on-period T2 is set to be a longer period as the second deviation D2 becomes greater as illustrated in FIG. 7. The relationship between the second all on-period T2 and the second deviation D2 is not limited to the frame Y of FIG. 5 but applies to all rows aligning horizontally.

As illustrated in FIG. 6, the pattern I is a pattern in which the first all on-period T1 does not overlap the second all on-period T2. Specifically, the second all on-period T2 is started just after the first all on-period T1 in the pattern I. The fact that the second all on-period T2 is started just after the first all on-period T1 means that a start point of the second all on-period T2 is just after an end point of the first all on-period T1. It is also preferable that the start point of the second all on-period T2 approximately coincides with the end point of the first all on-period T1.

In the first energization pattern P1 of the pattern I, the first start period T11, the first all on-period T1, and the first off-period T13 are set, and the first end period T12 is not set. In the second energization pattern P2 of the pattern I, the above-described periods T2, T21 to T23 are set.

In the first energization pattern P1 of the pattern I, the periods T11, T1, and T13 are set in order of the first all on-period T1 after the first start period T11, and the first off-period T13 after the first all on-period T1. In the second energization pattern P2 of the pattern I, the periods T23, T21, T2, and T22 are set in order of the second start period T21 after the second off-period T23, the second all on-period T2 after the second start period T21, and the second end period T22 after the second all on-period T2.

In the pattern I, a start time point of the first start period T11 and a start time point of the second off-period T23 coincides with a start time point of the control period T. In the pattern I, a start time point of the first all on-period T1 coincides with a start time point of the second start point T21. In the pattern I, an end time point of the first off period T13 and an end time point of the second end period T22 coincides with an end time point of the control period T.

That is, the energization pattern P of the pattern I corresponds to a prescribed energization pattern in which the first start-time phase control is started at the time of starting the control period T and the second end-time phase control is ended at the time of ending the control period T.

The pattern II is a pattern in which the second all on-period T2 is started just after the first all on-period T1 in the same manner as the pattern I. Specifically, the pattern II is the pattern in which the second end period T22 is removed from the pattern I. In the pattern II, an end time point of the second all on-period T2 coincides with an end time point of the control period T.

The pattern III is a pattern in which the first all on-period T1 overlaps the second all on-period T2. Specifically, the pattern III is the pattern in which the first end period T12 is added to the pattern I. In the pattern III, the first end period T12 is set between the first all on-period T1 and the first off-period T13. In the pattern III, a start time point of the second all on-period T2 is set after a start time point of the first all on-period T1 and before an end time point of the first all on-period T1. In the Pattern III, an end time point of the second all on-period T2 coincides with an end time point of the first end period T12.

Also in the pattern III, a start time point of the first start period T11 coincides with the start time point of the control period T in the same manner as the pattern I, and an end time point of the second end period T22 coincides with the end time point of the control period T. Accordingly, the energization pattern P of the pattern III also corresponds to the above prescribed energization pattern.

The pattern IV is a pattern in which the first all on-period T1 overlays the second all on-period T2 in the same manner as the pattern III, in which the first all on-period T1 is set over a period from the start to the end of the control period T. Specifically, the pattern IV is the pattern in which the first start period T11, the first off-period T13 and the second off-period T23 are removed from the pattern I.

In the pattern IV, a start time point of the first all on-period T1 and a start time point of the second start period T21 coincides with the start time point of the control period T. In the pattern IV, an end time point of the first all on-period T1 and an end time point of the second end period T22 coincides with the end time point of the control period T.

As illustrated in FIG. 7, the pattern V is a pattern in which the first all on-period T1 overlays the second all on-period T2 in the same manner as the pattern III, which is the pattern in which the second all on-period T2 is set over the period from the start to the end of the control period T. Specifically, the pattern V is a pattern in which the first off-period T13, the second start period T21, the second end period T22, and the second off-period T23 are removed from the pattern III.

In the pattern V, a start time point of the second all on-period T2 coincides with the start time point of the control period. In the pattern V, an end time point of the first end period T12 and an end time point of the second all on-period T2 coincides with the end point of the control period T.

The pattern VI is not illustrated, which is a pattern in which the first all on-period T1 and the second all on-period T2 are set over the period from the start to the end of the control period T.

Figure 8A:
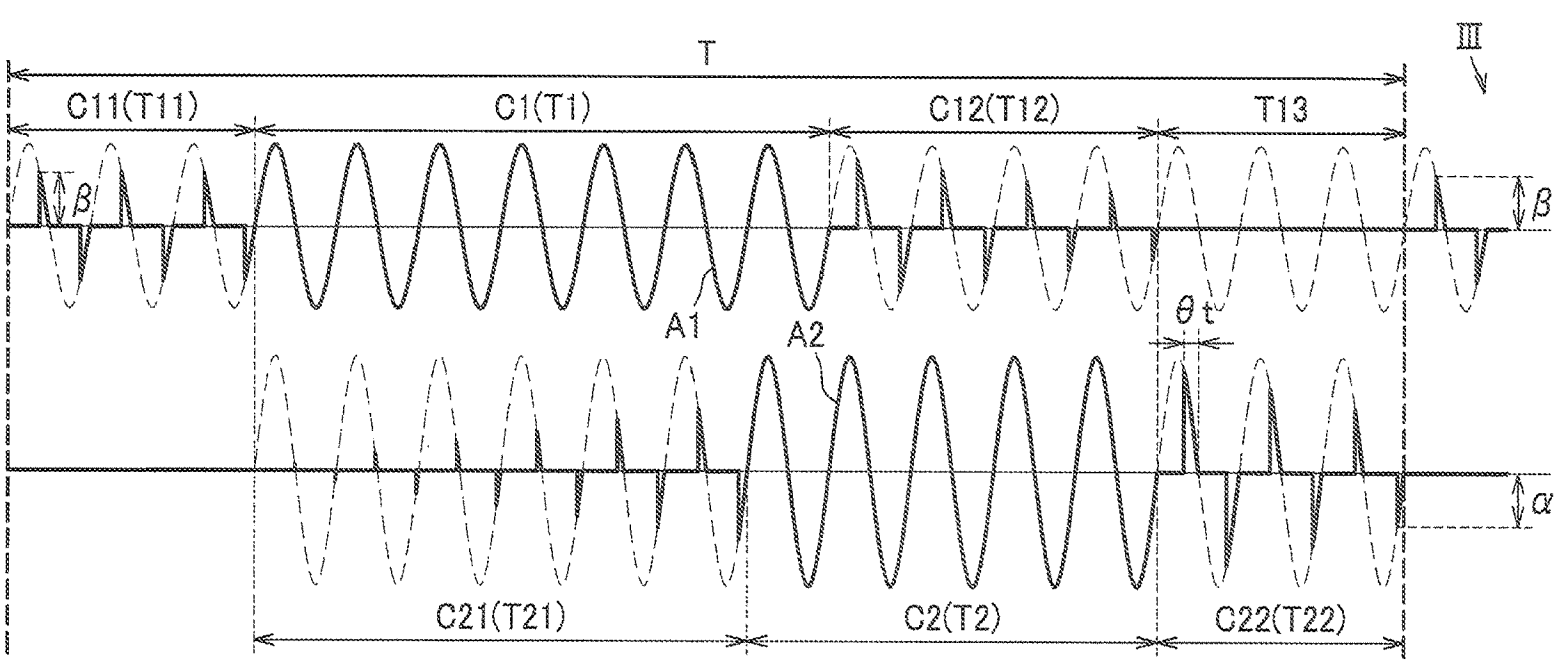
FIG. 8A is a chart showing energization control in a pattern III.

The controller 100 is capable of executing the first continuous energization control, the second continuous energization control, and the phase control based on the energization pattern P. As illustrated in FIG. 8A, a first continuous energization control C1 is the control during which a first AC current A1 is continuously applied to the first heater H1. A second continuous energization control C2 is the control during which a second AC current A2 is continuously applied to the second heater H2. Here, waveforms illustrated in FIG. 8A are waveforms corresponding to the pattern III. Respective controls such as the first continuous energization control and the second continuous energization control are executed in the same manner in every pattern, therefore, respective controls will be explained by using waveforms illustrated in FIG. 8A.

A peak of the second AC current A2 is greater than a peak of the first AC current A1. That is, the peak of current in energization of the second continuous energization control C2 is greater than the peak of current in energization of the first continuous energization control C1.

The phase control is a control in which energization is executed in parts of sine waves of AC current. Specifically, the phase control is the control in which energization is executed in each part less than a half wave of a sine wave (each latter half part of the half wave). The controller 100 supplies the AC current to each of the heater H1 and the heater H2 based on a target phase angle θt in the phase control.

Here, phase angles are defined so that a phase angle at an end point of a given half wave is 0 (zero) degrees and a phase angle at a start point of the given half wave is 180 degrees. That is, a position of a current value 0 (zero) after an absolute value of the current value becomes decreased is defined as the phase angle 0 (zero) degrees in the given half wave, and the phase angle is assumed to be gradually increased from the position toward the start point of the given half wave, namely, a range of phase angles is set from 0 (zero) to 180 degrees. A range of phase angles used for the control is from 0 (zero) to 90 degrees.

The controller 100 changes the target phase angle θt or fixes the target phase angle θt to a constant value during an execution period of the phase control, thereby performing intermittent energization. The controller 100 is capable of executing a first start-time phase control C11, a first end-time phase control C12, a second start-time phase control C21, and a second end-time phase control C22 as the phase controls.

The first start-time phase control C11 is a phase control executed before the first continuous energization control C1, and is the phase control in which energization is executed to the first heater H1 in parts of sine waves of the first AC current A1. The controller 100 fixes the target phase angle θt to be constant, for example, when the first start-time phase control C11 is executed in the pattern I illustrated in FIG. 9 or in the pattern III illustrated in FIG. 8. That is, the target phase angle θt is fixed to be constant when a period of the first start time T11 has to be set for an extremely short period of time as in the patterns I to III. Here, the target phase angle θt in the case where the target phase angle θt is fixed to be constant is set to be values less than 90 degrees and greater than 0 (zero) degrees.

The controller 100 gradually increases an energization amount per a half wave of the first AC current A1 by changing the target phase angle θt when the first start-time phase control C11 is executed in the pattern V illustrated in FIG. 7. That is, the target phase angle θt is changed in a case where the period of the first start time T11 can be set to a sufficiently long period of time as in the pattern V.

Specifically, the controller 100 gradually increases the target phase angle θt from 0 (zero) degrees toward 90 degrees so that an absolute value of a current peak in each half wave is gradually increased from the state where the current value is 0 (zero) toward the peak of the first AC current A1. As methods of gradually increasing the target phase angle θt, there are methods, for example, a method of proportionally increasing the target phase angle θt by adding angles by a predetermined amount from 0 (zero) degrees, a method of increasing the target phase angle θt logarithmically or exponentially, and so on. In the method of increasing target phase angle θt by the predetermined amount, for example, a value obtained by dividing the phase angle 90 degrees by the number of half waves falling within the execution period (T11) of the first start-time phase control C11 can be set as the predetermined amount.

The first end-time phase control C12 is a phase control executed after the first continuous energization control C1, and is the phase control in which energization is executed to the first heater H1 in parts of the sine waves of the first AC current A1. The controller 100 gradually decreases the energization amount per a half wave of the first AC current A1 by changing the target phase angle θt, for example, when the first end-time phase control C12 is executed in the pattern III illustrated in FIG. 8. That is, the target phase angle θt is changed when the period of the first end-time period T12 can be set to a sufficiently long period of time as in the pattern III.

Specifically, the controller 100 gradually decreases the target phase angle θt from 90 degrees to 0 (zero) degrees so that the absolute value of the current peak in each half wave is gradually decreased from the peak of the first AC current A1. As methods of gradually decreasing the target phase angle θt, there are methods, for example, a method of proportionally decreasing the target phase angle θt, a method of decreasing the target phase angle θt logarithmically or exponentially, and so on in the same manner as the above-described method of increasing the angle.

The controller 100 fixes the target phase angle θt to be constant when the first end-time phase control C12 is executed in the pattern V illustrated in FIG. 7. It is also possible to change the target phase angle θt so that the energization amount per a half wave is gradually decreased in the first end-time phase control C12 in the pattern V.

The second start-time phase control C21 is a phase control executed before the second continuous energization control C2, and is the phase control in which energization is executed to the second heater H2 in parts of sine waves of the second AC current A2. The second start-time phase control C21 is the control similar to the first start-time phase control C11. The controller 100 changes the target phase angle θt or fixes the target phase angle θt to a constant value in accordance with the length of the second start period T21.

Figure 8B:
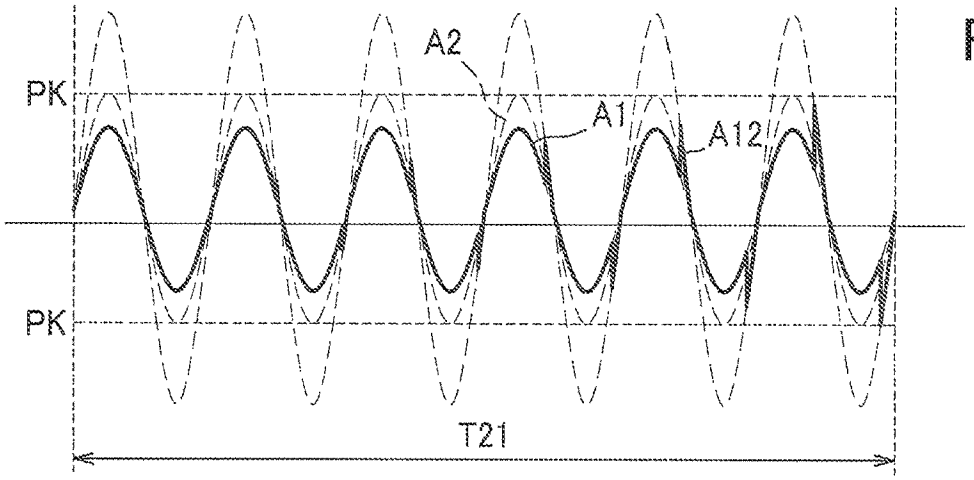
FIG. 8B is a chart showing a composite waveform in a first start-time phase control.
Figure 8C:
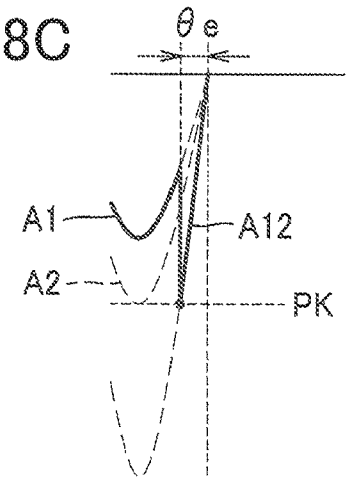
FIG. 8C is an enlarged view showing a last half wave of the composite waveform.
Figure 9:
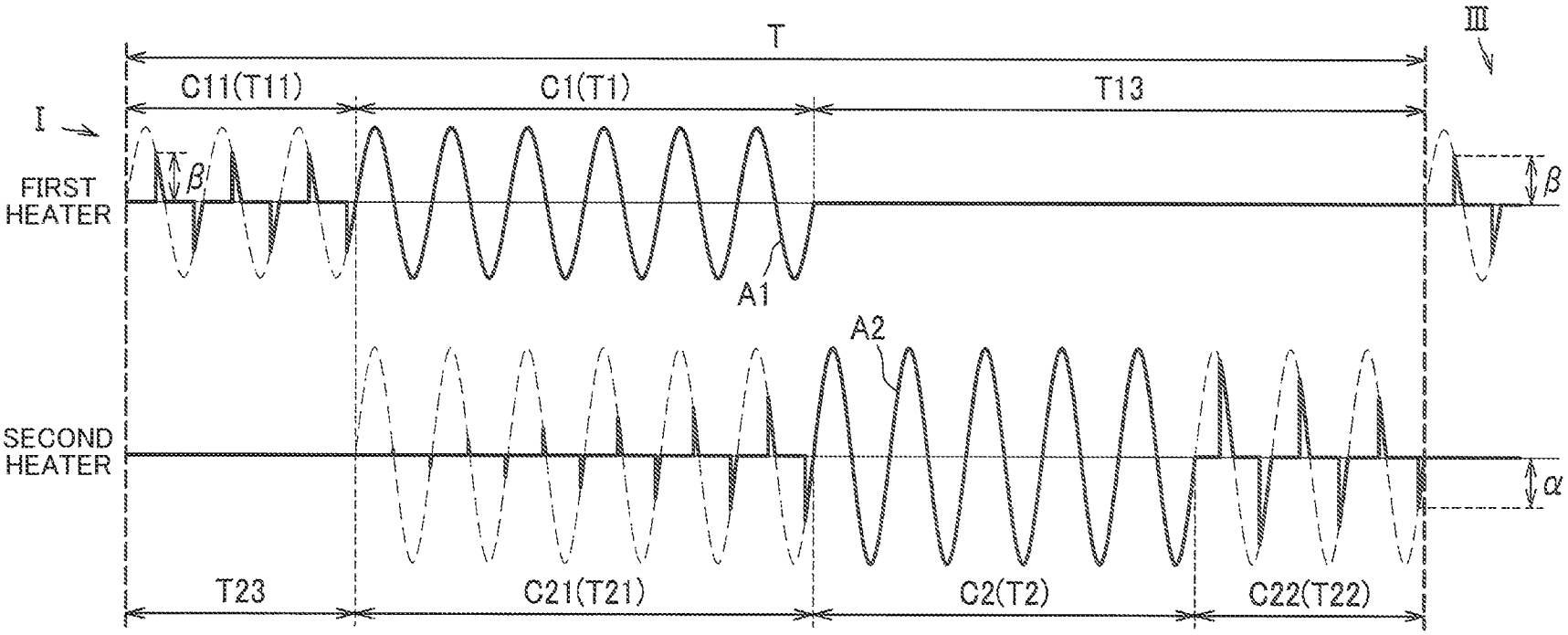
FIG. 9 is a chart showing energization control in a pattern I.

As an example, the controller 100 gradually increases an energization amount per a half wave of the second AC current A2 by changing the target phase angle θt when the second start-time phase control C21 is executed in the pattern I illustrated in FIG. 9 or in the pattern III illustrated in FIG. 8. Specifically, the controller 100 gradually increases the target phase angle θt from 0 (zero) degrees so that an absolute value of a current peak in each half wave is gradually increased from the state where the current value is 0 (zero) toward the peak of the second AC current A2. As methods of gradually increasing the target phase angle θt, similar methods to the methods used for the first start-time phase control C11 can be used.

FIG. 8B is an enlarged view illustrating a composite waveform of the first AC current A1 and the second AC current A2 in the second start period T21. FIG. 8C is an enlarged view of a last half wave of the composite waveform of the FIG. 8B. As illustrated in FIGS. 8B and 8C, the controller 100 executes energization so that a composite value A12, i.e. a sum A12, of the first AC current A1 and the second AC current A2 is equal to or less than a peak PK of the second AC current A2 in the second start-time phase control C21. Specifically, the controller 100 calculates a last phase angle θe, in the last half wave of the composite value A12, which is the same current value as the peak PK of the second AC current A2, and sets the last phase angle θe to the last target phase angle θt of the second start-time phase control C21. Then, the controller 100 sets values obtained by sequentially subtracting a predetermined amount from the last phase angle θe from the last half wave of the second start-time phase control C21 toward the first half wave as target phase angles θt of respective half waves.

As illustrated in FIG. 8A, the second end-time phase control C22 is a phase control executed after the second continuous energization control C2, and is the phase control in which energization is executed to the second heater H2 in parts of sine waves of the second AC current A2. The second end-time phase control C22 is the control substantially similar to the first end-time phase control C12. The controller 100 changes the target phase angles θt or fixes the target phase angles θt to a constant value in accordance with the length of the second end period T22.

As an example, the controller 100 gradually decreases the energization amount per a half wave of the second AC current A2 by changing the target phase angle θt when the second end-time phase control C22 is executed in the pattern I illustrated in FIG. 9 or in the pattern III illustrated in FIG. 8. Specifically, the controller 100 gradually decreases the target phase angle θt from 90 degrees so that the energization amount per a half wave is gradually decreased by the approximately same method as the first end-time phase control C12.

Here, the energization patterns P in the patterns I, III correspond to the above-described prescribed energization pattern. The prescribed energization pattern is set so that a first peak current value β in the first start-time phase control C11 agrees with a last peak current value α which is a composite value of the first AC current A1 and the second AC current A2 at the end of the second end-time phase control C22. As the execution periods of respective phase controls C11, C12, C21, and C22 are set not to overlap in the embodiment, energization to the first heater H1 is stopped and the first AC current A1 becomes 0 (zero) at the end of the second end-time phase control C22. Accordingly, the last peak current value a of the second AC current A2 in the control period T is the composite value of the first AC current A1 and the second AC current A2 at the end of the second end-time phase control C22.

The controller 100 starts the second continuous energization control C2 just after an end of the first continuous energization control C1 as illustrated in FIG. 9 in a case where a first condition illustrated by the following formula (1) is satisfied.

$$T1+T2<T \tag{1}$$

T: the control period, T1: the first all on-period, T2: the second all on-period Specifically, the condition illustrated by the following formula (2) is prescribed as the first condition when setting a minimum period required for executing the first start-time phase control C11 to $T11_{min}$ in the embodiment.

$$T11_{min}+T1+T2<T \tag{2}$$

That is, the first condition does not include a condition relating to the first end period T12, the second start period T21, and the second end period T22.

The controller 100 stops energization without executing the first end-time phase control C12 after the first continuous energization control C1 when the first condition is satisfied. The controller 100 starts the second start-time phase control C21 at the same time as the start of the first continuous energization control C1 when the first condition is satisfied.

The case where the first condition is satisfied means a case where the pattern I or the pattern II is selected based on the deviation D1 and the deviation D2. In other words, the first condition means that the first detected temperature and the second detected temperature become temperatures which require selecting the pattern I or the pattern II.

The controller 100 starts the second continuous energization control C2 in the middle of execution of the first continuous energization control C1 as illustrated in FIG. 8 in a case where a second condition having conditions illustrated by the following formulas (3), (4) is satisfied.

$$T1+T2\geq T \tag{3}$$

$$T1>T2 \tag{4}$$

Specifically, the condition illustrated by the following formula (5) is prescribed as the second condition when setting the minimum period required for executing the first start-time phase control C11 to $T11_{min}$ in the embodiment.

$$T11_{min}+T1+T2>T \tag{5}$$

The controller 100 executes the first end-time phase control C12 after the first continuous energization control C1 when the second condition is satisfied and T1<T is satisfied. The controller 100 stops energization to the first heater H1 after an end of the first end-time phase control C12 when the second condition is satisfied and T1<T is satisfied. The controller 100 executes the second end-time phase control C22 just after an end of the first end-time phase control C12 when the second condition is satisfied and T1<T is satisfied.

The case where the second condition is satisfied means a case where the pattern III or the pattern VI is selected based on the deviation D1 and the deviation D2. In other words, the second condition means that the first detected temperature and the second detected temperature become temperatures which require selecting the pattern III or the pattern VI.

The case where the second condition is satisfied and T1<T is satisfied means that the pattern III is selected based on the deviation D1 and the deviation D2. In other words, the case where second condition is satisfied and T1<T is satisfied means that the first detected temperature and the second detected temperature become temperatures which require selecting the pattern III.

Next, the operation of the controller 100 will be explained with reference to a flowchart illustrated in FIG. 10. The controller 100 executes processing illustrated in FIG. 10 repeatedly in the control period T until the print is completed when receiving a print command.

Figure 10:
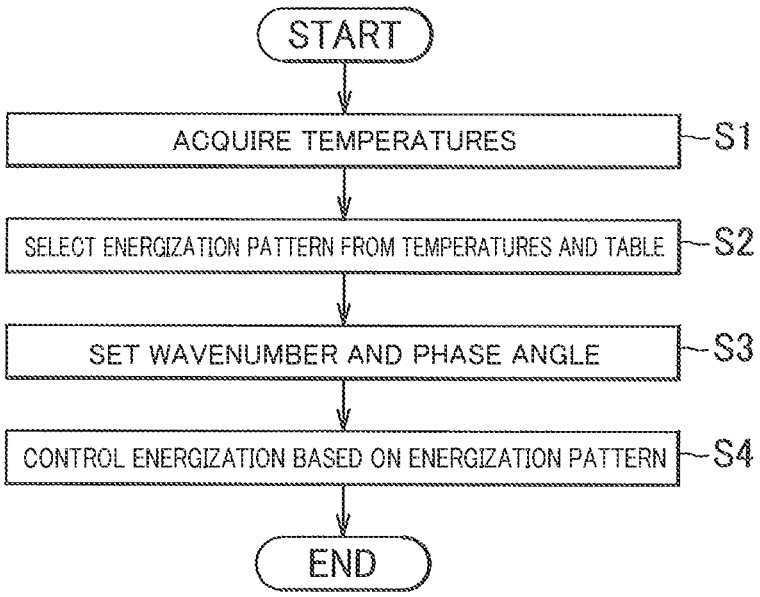
FIG. 10 is a flowchart showing the operation of the controller.

In the processing illustrated in FIG. 10, the controller 100 first acquires temperatures of the first temperature detector ST1 and the second temperature detector ST2 (S1). After Step S1, at Step S2, the controller 100 selects the energization pattern P based on the detected temperatures acquired from the temperature detector ST1 and the temperature detector ST2 and the table of FIG. 5. Specifically, the controller 100 calculates the first deviation D1 and the second deviation D2 from the detected temperatures and the target temperatures and selects the energization pattern P based on the deviation D1, the deviation D2 and the table in Step S2.

After Step S2, at Step S3, the controller 100 sets a wavenumber and a target phase angle in each phase control based on the respective start periods of T11, T21 and the respective end periods of T12, T22 set in the energization pattern P. After Step S3, at Step S4, the controller 100 executes energization control based on the energization pattern P and ends the processing.

Next, a specific example of the operation of the controller 100 will be explained.

As illustrated in FIG. 5, when a condition of deviations is j≤D1<k and d≤D2<e, the controller 100 selects the pattern I as the energization pattern P. In the pattern I, as illustrated in FIG. 6, the first start period T11, the second all on-period T1, the first off-period T13, the second off-period T23, the second start period T21, the second all on-period T2, and the second end period T22 are set.

The controller 100 fixes the target phase angle to a predetermined value in the first start-time phase control C11 executed in the first start period T11. The controller 100 calculates wave numbers based on lengths of respective periods and sets target phase angles in the respective half waves based on the wave numbers for the second start-time phase control C21 executed in the second start period T21 and the second end-time phase control C22 executed in the second end period T22.

After that, the controller 100 executes energization control based on the pattern I as illustrated in FIG. 9. Specifically, the controller 100 first starts the first start-time phase control C11 in a state in which energization to the second heater H2 is stopped. At this time, the controller 100 executes the first start-time phase control C11 while fixing the target phase angle to be constant.

The controller 100 ends the first start-time phase control C11 after the first start-time phase control C11 is executed for the first start period T11, and starts the first continuous energization control C1 and the second start-time phase control C21 at the same time. In the second start-time phase control C21, the controller 100 gradually increases the current peak per a half wave by gradually increasing the target phase angle. Specifically, the controller 100 gradually increases the target phase angle so that a composite peak current value of the first AC current A1 and the second AC current A2 gradually comes close to the peak current value of the second AC current A2.

The controller 100 ends the first continuous energization control C1 and the second start-time phase control C21 after the first continuous energization control C1 and the second start-time phase control C21 are executed for a predetermined period (T1, T21). After the first continuous energization control C1 and the second start-time phase control C21 are ended, the controller 100 stops energization to the first heater H1 and starts the second continuous energization control C2.

The controller 100 starts the second end-time phase control C22 after the second continuous energization control C2 is executed for the second all on-period T2. In the second end-time phase control C22, the controller 100 gradually decreases the current peak per a half wave by gradually decreasing the target phase angle. Specifically, the controller 100 gradually decreases the current peak per a half wave so that the peak current value α in the last half wave of the second end-time phase control C22 becomes a predetermined value (the same value as the first peak current value β in the first start-time phase control C11). Accordingly, when the energization pattern P to be selected next is the pattern I, the pattern II or the pattern III, the last peak current value in energization control by the energization pattern P at this time is allowed to agree with the first peak current value in energization control by the energization pattern P to be selected next.

The controller 100 selects the next energization pattern P (for example, the pattern I) after the second end-time phase control C22 is executed for the second end period T22, and executes energization control in the selected energization pattern P.

As illustrated in FIG. 5, when the condition of deviations is o≤D1<p and d≤D2<e, the controller 100 selects the pattern III as the energization pattern P. In the pattern III, the first end period T12 is set in addition to the respective periods set in the pattern I as illustrated in FIG. 6. The controller 100 calculates the wave number based on the length of the period and sets the target phase angle based on the wave number for the first end-time phase control C12 executed in the first end period T12. Other phase controls are set in the same manner as in the case where the pattern I is selected.

After that, the controller 100 executes energization control based on the pattern III as illustrated in FIG. 8. In the following explanation, explanation for the same operation as in the case where the energization control is executed based on the pattern I is omitted.

The controller 100 ends the second start-time phase control C21 in the middle of execution of the first continuous energization control C1 and starts the second continuous energization control C2. The controller 100 ends the first continuous energization control C1 in the middle of execution of the second continuous energization control C2 and starts the first end-time phase control C12. In the first end-time phase control C12, the controller 100 gradually decreases the target phase angle so that the current peak per a half wave gradually decreases toward 0 (zero).

After the first end period T12 passes from the start of the first end-time phase control C12, the controller 100 ends the first end-time phase control C12 and the second continuous energization control C2 at the same time. The controller 100 stops energization to the first heater H1 and starts the second end-time phase control C22 after the first end-time phase control C12 and the second continuous energization control C2 are ended.

According to the above, the following advantages can be obtained in the embodiment.

In the case where the pattern I or the pattern II is selected as the energization pattern P, the first continuous energization control C1 and the second continuous energization control C2 are successively performed in the control period T by starting the second continuous energization control C2 just after the end of the first continuous energization control C1, which means that one continuous energization control is executed in the control period T, therefore, momentary voltage drop occurring in the control period T can be suppressed to once.

When the first condition is satisfied, the first end-time phase control C12 is not executed after the first continuous energization control C1, therefore, the peak of the composite current can be suppressed in the second continuous energization control C2.

The current peak in energization of the second continuous energization control C2 is greater than the current peak in energization of the first continuous energization control C1, therefore, the second area 81B and the second area 81C of the heating member 81 can be heated quickly.

The energization is executed in the second start-time phase control C21 so that the composite value of the first AC current A1 and the second AC current A2 is equal to or less than the peak of the second AC current A2, therefore, the peak of the composite current can be suppressed while the first continuous energization control C1 and the second start-time phase control C21 are executed at the same time.

The energization amount per a half wave of the second AC current A2 is gradually increased in the second start-time phase control C21, therefore, it is possible to inhibit current flowing in the second heater H2 from suddenly changing.

The energization amount per a half wave of AC current is gradually decreased in the first end-time phase control C12 and the second end-time phase control C22, therefore, it is possible to inhibit current flowing in each of the heater H1 and the heater H2 from suddenly changing.

In the case where the energization pattern P is determined as the prescribed energization pattern (for example, the pattern I or the pattern III) both in a current given control period T and a control period T subsequent to the current given control period T, the last composite peak current value a of the first AC current A1 and the second AC current A2 at the end of the second end-time phase control C22 in the current given control period T agrees with the first peak current value β of the first start-time phase control C11 in the subsequent control period T. Accordingly, sudden change of current used in the fixing device 8 at the time of switching the energization pattern P can be suppressed.

When the second condition is satisfied and T1<T is satisfied, the first end-time phase control C12 is executed after the first continuous energization control C1, therefore, it is possible to inhibit current flowing in the first heater H1 from suddenly changing.

The present disclosure is not limited to the above embodiment, and can be used in various manners illustrated as follows. In the following explanation, the same reference signs are given to controls and so on similar to those of the embodiment, and explanation thereof is omitted.

Figure 11:
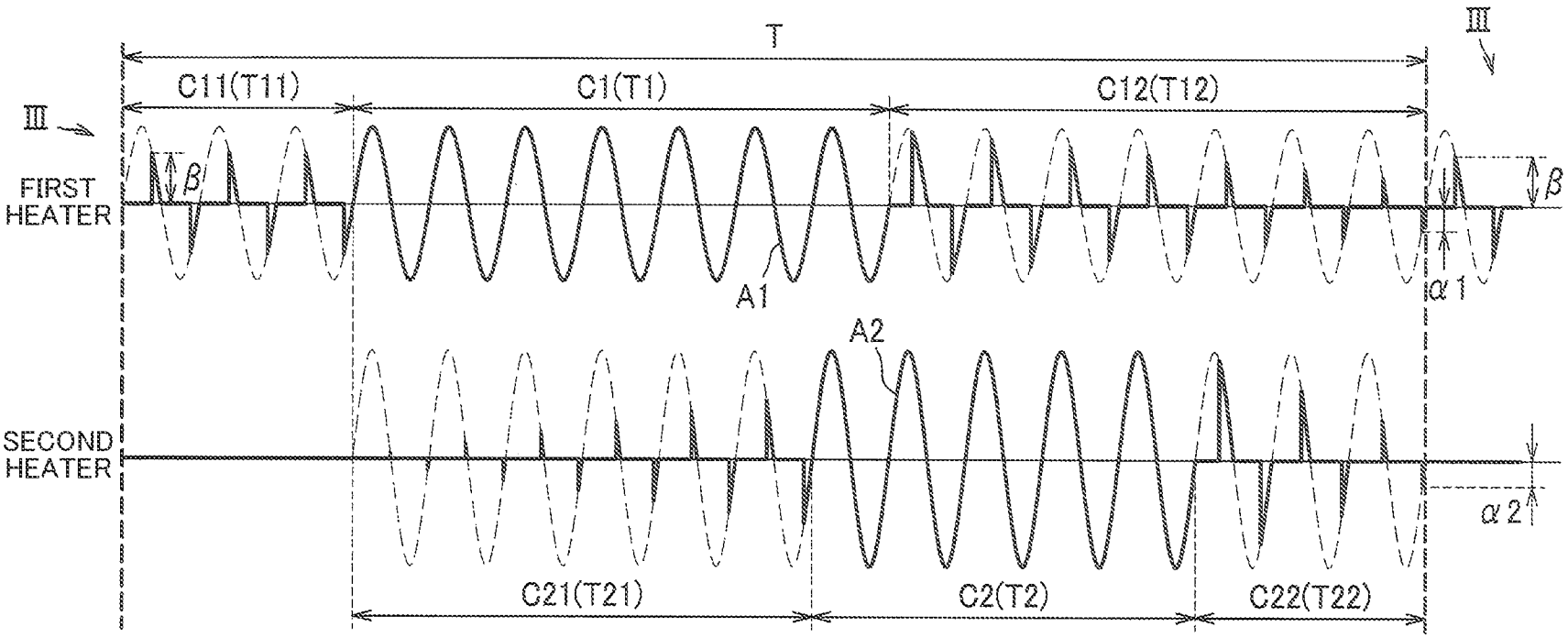
FIG. 11 is a chart showing a state in which an execution period of a first end-time phase control overlaps with an execution period of a second end-time phase control.

The energization pattern P is set so that the execution periods of the respective phase controls do not overlap in the embodiment, however, the present disclosure is not limited to this. For example, in the energization control by the pattern III, the execution period (T12) of the first end-time phase control C12 may overlap with the execution period (T22) of the second end-time phase control C22 as illustrated in FIG. 11.

Specifically, the first end-time phase control C12 may be executed to an end point of the control period T in the energization control by the pattern III. In this case, it is preferable that the second end-time phase control C22 is executed by the controller 100 by setting the last target phase angle θt so that a value obtained by adding a peak current value α1 of the last half wave in the first end-time phase control C12 to a peak current value α2 of the last half wave in the second end-time phase control C22 agrees with the first peak current value β in the first start-time phase control C11.

The energization pattern P is determined by using the table illustrated in FIG. 5 in the embodiment, however, the present disclosure is not limited to this. For example, the energization pattern may be determined by using a function and so on.

The first area 81A is defined as the area including the central part in the width direction of the heating member 81 and each of the second area 81B and the second area 81C is defined as an area on an end side of the first area 81A in the heating member 81 in the embodiment, however, the present disclosure is not limited to this. It is sufficient that the first area and the second area are at different positions respectively in the width direction.

The energization amount per a half wave of AC current is gradually decreased in both the first end-time phase control and the second end-time phase control in the embodiment, however, the present disclosure is not limited to this. It is also preferable that the energization amount per a half wave of AC current may be gradually decreased in any one of the first end-time phase control and the second end-time phase control.

The second start-time phase control is started at the same time as the start of the first continuous energization control in the embodiment, however, the present disclosure is not limited to this. The second start-time phase control may be executed in the middle of execution of the first continuous energization control. Specifically, the second start-time phase control may be started after the start of the first continuous energization control.

The sheet S may be papers such as thick papers, postal cards, and thin papers, or OHP sheets.

A developer image forming portion may be optionally formed. For example, a developer image forming portion in which the photoconductor drum is exposed by an LED head may be adopted.

The heating roller is explained as an example of the heating member in the embodiment, however, the present disclosure is not limited to this. For example, the heating member may be a plate-shaped nip member heated by a heater, a fixing belt sandwiched between the nip member and the pressure member, and so on. Further, as mentioned above, the heating member 81 is a rotatable cylindrical-shaped roller, however, the present disclosure is not limited to this. The heating member may be an endless belt to be rotated and a nip forming member which causes the endless belt to be nipped between the pressure member 83 and the nip forming member. Furthermore, as mentioned above, the pressure member 82 may be an endless belt to be rotated and a nip forming member which causes the endless belt to be nipped between the heating member 81 and the nip forming member.

The halogen lamp is described as an example of the heater in the embodiment, however, the present disclosure is not limited to this. For example, the heater may be a solid heating element such as a carbon heater.

The thermistor is described as an example of the temperature detector in the embodiment, however, the present disclosure is not limited to this. Any types of sensors detecting temperatures may be adopted.

The first temperature detector ST1 does not contact the heating member 81 in the embodiment, however, the present disclosure is not limited to this. The first temperature detector may contact the heating member. The second temperature detector may be set so as not to contact the heating member.

The present disclosure is applied to the laser printer 1 in the embodiment, however, the present disclosure is not limited to this. The present disclosure may be applied to, for example, a color printer, a copier, a composite machine, and so on.

In the embodiment, the phase angle is set so that the phase angle is gradually increased from the end point toward the start point of a given half wave, however, the present disclosure is not limited to this. It is also preferable that the phase angle is set so that phase angle is gradually increased from the start point toward the end point of a given half wave. That is, the phase angle at the start point of the given half wave may be defined as 0 (zero) degrees and the phase angle at the end point may be defined as 180 degrees. In this case, when a range of phase angles used for controls is 90 degrees to 180 degrees, increase/decrease of phase angles in respective controls may be reversed to that in the embodiment.

Respective elements explained in the above embodiment and modified examples may be arbitrarily combined to be achieved.

What is claimed is:

1. A fixing device, comprising:

a heating member configured to heat a sheet;

a first heater having an output peak in a first area of the heating member and configured to heat the heating member;

a second heater having an output peak in a second area different from the first area of the heating member and configured to heat the heating member;

a first temperature detector configured to detect a temperature of the first area;

a second temperature detector configured to detect a temperature of the second area; and a controller configured to control energization to the first heater and the second heater based on an energization pattern determined, for each control period, based on a first detected temperature detected by the first temperature detector and a second detected temperature detected by the second temperature detector, the control period being a unit time in which the energization pattern for the first heater and the second heater is set and repeatedly executed from a timing when the controller receives a print command to a timing when a print based on the print command is completed, wherein, in a case where a length of the control period is T, a length of a period during which a first continuous energization control in which first AC current is continuously applied to the first heater is executed is T1, and a length of a period during which a second continuous energization control in which second AC current is continuously applied to the second heater is executed is T2, when a first condition represented by T1+T2<T is satisfied, the controller is configured to start the second continuous energization control just after an end of the first continuous energization control.

2. The fixing device according to claim 1, wherein the controller is configured to execute a second start-time phase control in the middle of execution of the first continuous energization control, the second start-time phase control being a control executed before the second continuous energization control and energizing the second heater in parts of sine waves of the second AC current.

3. The fixing device according to claim 2, wherein the controller is configured to start the second start-time phase control at the same time as a start of the first continuous energization control when the first condition is satisfied.

4. The fixing device according to claim 2, wherein the controller is configured to stop, after the first continuous energization control is completed, energization to the first heater without executing a first end-time phase control when the first condition is satisfied, the first end-time phase control being a control executable after the first continuous energization control and energizing the first heater in parts of sine waves of the first AC current.

5. The fixing device according to claim 4, wherein a peak current in energization of the second continuous energization control is greater than a peak current in energization of the first continuous energization control.

6. The fixing device according to claim 2, wherein the first condition does not include a condition relating to a period of execution of the second start-time phase control.

7. The fixing device according to claim 2, wherein the controller is configured to execute energization to the first heater and the second heater so that a composite value of the first AC current and the second AC current is equal to or less than a peak current of the second AC current in the second start-time phase control.

8. The fixing device according to claim 2, wherein the controller is configured to gradually increase an energization amount of the second AC current per a half wave by changing a phase angle in the second start-time phase control.

9. The fixing device according to claim 1, wherein the controller is configured to fix a phase angle to be constant in a first start-time phase control, the first start-time phase control being a control executed before the first continuous energization control and energizing the first heater in parts of sine waves of the first AC current.

10. The fixing device according to claim 1, wherein the controller is configured to gradually decrease an energization amount of AC current per a half wave by changing the phase angle in (i) a first end-time phase control, (ii) a second end-time phase control, or (iii) both of the first-end-time phase control and the second end-time phase control, the first end-time phase control being a control executable after the first continuous energization control and energizing the first heater in parts of sine waves of the first AC current, the second end-time phase control being a control executable after the second continuous energization control and energizing the second heater in parts of sine waves of the second AC current.

11. The fixing device according to claim 1, wherein the controller is configured to start the second continuous energization control just after the end of the first continuous energization control without executing a first end-time phase control or a second start-time phase control, the first end-time phase control being a control executable after the first continuous energization control and energizing the first heater in parts of sine waves of the first AC current, the second start-time phase control being a control executed before the second continuous energization control and energizing the second heater in parts of sine waves of the second AC current.

12. A method for controlling a fixing device which comprises a heating member configured to heat a sheet, a first heater having an output peak in a first area of the heating member and configured to heat the heating member, a second heater having an output peak in a second area different from the first area of the heating member and configured to heat the heating member, the method comprising the steps of:

controlling energization to the first heater and the second heater based on an energization pattern determined, for each control period, based on a temperature of the first area and a temperature of the second area, the control period being a unit time in which the energization pattern for the first heater and the second heater is set and repeatedly executed from a timing when a print command is received to a timing when a print based on the print command is completed; and in a case where a length of the control period is T, a length of a period during which a first continuous energization control in which first AC current is continuously applied to the first heater is executed is $T_1$, and a length of a period during which a second continuous energization control in which second AC current is continuously applied to the second heater is executed is $T_2$, when a first condition represented by $T_1+T_2<T$ is satisfied, starting a second continuous energization control just after an end of a first continuous energization control.

13. The method for controlling the fixing device according to claim 12, wherein the method comprises the step of, when the first condition is satisfied, starting the second continuous energization control just after the end of the first continuous energization control without executing a first end-time phase control or a second start-time phase control, the first end-time phase control being a control executable after the first continuous energization control and energizing the first heater in parts of sine waves of the first AC current, the second start-time phase control being a control executed before the second continuous energization control and energizing the second heater in parts of sine waves of the second AC current.

14. A fixing device, comprising:

a heating member configured to heat a sheet;

a first heater having an output peak in a first area of the heating member and configured to heat the heating member;

a second heater having an output peak in a second area different from the first area of the heating member and configured to heat the heating member;

a first temperature detector configured to detect a temperature of the first area;

a second temperature detector configured to detect a temperature of the second area; and a controller configured to control energization to the first heater and the second heater based on an energization pattern determined, for each control period, based on a first detected temperature detected by the first temperature detector and a second detected temperature detected by the second temperature detector, the control period being a unit time in which the energization pattern for the first heater and the second heater is set and repeatedly executed from a timing when the controller receives a print command to a timing when a print based on the print command is completed, wherein the energization pattern includes a prescribed energization pattern in which (i) a first start-time phase control is started at a start of the control period and a second end-time phase control is ended at an end of the control period and (ii) a peak current that is a first peak current value in the first start-time phase control in a second control period is a same value as a last peak current value as a composite value of first AC current and second AC current at an end of the second end-time phase control in a first control period, the first start-time phase control being a control executed before a first continuous energization control in which the first AC current is continuously applied to the first heater is executed and energizing the first heater in parts of sine waves of the first AC current, the second end-time phase control being a control executable after a second continuous energization control in which the second AC current is continuously applied to the second heater is executed and energizing the second heater in parts of sine waves of the second AC current, the first control period and the second control period being executed consecutively in this order as two of the control period.

15. The fixing device according to claim 14, wherein the controller is configured to execute (i) a first end-time phase control that is a control executed after the first continuous energization control and energizing the first heater in parts of sine waves of the first AC current, and (ii) a second start-time phase control that is a control executed before the second continuous energization control and energizing the second heater in parts of sine waves of the second AC current.

16. The fixing device according to claim 14, wherein the controller is configured to gradually decrease an energization amount of the second AC current per a half wave by changing a phase angle in the second end-time phase control.

17. The fixing device according to claim 14, wherein, in a case where a length of the control period is T, a length of a period during which the first continuous energization control is $T_1$, and a length of a period during which the second continuous energization control is $T_2$, when a first condition represented by $T_1+T_2<T$ is satisfied, the controller is configured to start the second continuous energization control just after an end of the first continuous energization control.

18. The fixing device according to claim 17, wherein the controller is configured to stop, after the first continuous energization control is completed, energization to the first heater without executing a first end-time phase control when the first condition is satisfied, the first end-time phase control being a control executable after the first continuous energization control and energizing the first heater in parts of sine waves of the first AC current.

19. The fixing device according to claim 14, wherein a peak current in energization of the second continuous energization control is greater than a peak current in energization of the first continuous energization control, and wherein, in a case where a length of the control period is T, a length of a period during which the first continuous energization control is T1, and a length of a period during which the second continuous energization control is T2, when a second condition represented by T1+T2≥T and T1>T2 is satisfied, the controller is configured to start the second continuous energization control in the middle of the first continuous energization control.

20. The fixing device according to claim 19, wherein, when the second condition is satisfied and T1<T is satisfied, the controller is configured to execute a first end-time phase control after the first continuous energization control, the first end-time phase control being a control executed after the first continuous energization control and energizing the first heater in parts of sine waves of the first AC current.

* * * * *